US010354604B2

(12) United States Patent
Kim et al.

(10) Patent No.: US 10,354,604 B2
(45) Date of Patent: Jul. 16, 2019

(54) DISPLAY APPARATUS AND METHOD OF DRIVING THE SAME

(71) Applicant: Samsung Display Co., Ltd., Yongin Si, Gyeonggi-Do (KR)

(72) Inventors: Jinpil Kim, Suwon-si (KR); Yu-Kwan Kim, Incheon (KR); Sungjae Park, Wonju-si (KR); Namjae Lim, Gwacheon-si (KR); Iksoo Lee, Seoul (KR)

(73) Assignee: Samsung Display Co., Ltd. (KR)

( * ) Notice: Subject to any disclaimer, the term of this patent is extended or adjusted under 35 U.S.C. 154(b) by 864 days.

(21) Appl. No.: 14/868,179

(22) Filed: Sep. 28, 2015

(65) Prior Publication Data

US 2016/0171940 A1 Jun. 16, 2016

(30) Foreign Application Priority Data

Dec. 12, 2014 (KR) ..... 10-2014-0179582

(51) Int. Cl.
*G09G 3/36* (2006.01)

(52) U.S. Cl.
CPC ..... *G09G 3/3614* (2013.01); *G09G 3/3648* (2013.01); *G09G 2300/0426* (2013.01)

(58) Field of Classification Search
None
See application file for complete search history.

(56) References Cited

U.S. PATENT DOCUMENTS

| | | | | |
|---|---|---|---|---|
| 6,552,706 | B1 | 4/2003 | Ikeda et al. | |
| 2008/0278466 | A1* | 11/2008 | Joo | G09G 3/3614 345/205 |
| 2013/0241900 | A1* | 9/2013 | Ge | G09G 3/006 345/204 |
| 2014/0232624 | A1 | 8/2014 | Kim et al. | |

FOREIGN PATENT DOCUMENTS

| | | | |
|---|---|---|---|
| KR | 10-2006-0132122 | A | 12/2006 |
| KR | 10-2011-0011309 | A | 8/2011 |
| KR | 10-1304417 | B1 | 8/2013 |
| KR | 10-1441395 | B1 | 9/2014 |

* cited by examiner

*Primary Examiner* — Jennifer Mehmood
*Assistant Examiner* — Parul H Gupta
(74) *Attorney, Agent, or Firm* — Innovation Counsel LLP

(57) ABSTRACT

A display apparatus includes first-kind data lines and second-kind data lines. Each of the first-kind data lines is connected to one of two pixels arranged in a k-th pixel row and a (k+1)th pixel row. Each of the second-kind data lines is connected to two pixels arranged in different pixel columns in the k-th pixel row and the (k+1)th pixel row. At least two first-kind data lines are consecutively arranged.

6 Claims, 7 Drawing Sheets

DISPLAY APPARATUS AND METHOD OF DRIVING THE SAME

CROSS-REFERENCE TO RELATED APPLICATION

This U.S. non-provisional patent application claims priority under 35 U.S.C. § 119 of Korean Patent Application No. 10-2014-0179582, filed on Dec. 12, 2014, which is hereby incorporated by reference in its entirety.

BACKGROUND

1. Field

The present disclosure relates to a display apparatus and a method of driving the same. More particularly, the present disclosure relates to a display apparatus configured to operate in an inversion driving scheme and a method for driving the display apparatus.

2. Description of the Related Art

In recent years, various transmissive display apparatuses, such as a liquid crystal display apparatus, an electrophoretic display apparatus, and an electrowetting display apparatus have been developed.

The liquid crystal display apparatus changes an alignment of liquid crystal molecules to control a transmittance of light incident thereto. To this end, the liquid crystal display apparatus applies an electric field to a liquid crystal layer disposed between two substrates, thereby changing the alignment of the liquid crystal molecules. The liquid crystal display apparatus controls the transmittance of the light passing through pixels to display an image.

There are various schemes for driving a liquid crystal display apparatus in accordance with a phase of data voltages applied to data lines, for example, but not limited to, a line inversion scheme, a column inversion scheme, and a dot inversion scheme.

SUMMARY

The present disclosure provides a display apparatus capable of reducing a moving line-stain phenomenon and a ripple phenomenon in a common voltage. The present further a method of driving the display apparatus.

According to some embodiments, a display apparatus includes a plurality of gate lines, a plurality of data line groups, and a plurality of pixels. Each data line group of the plurality of data line groups includes eight data lines sequentially arranged in a direction in which the plurality of gate lines extend. The plurality of pixels are connected to the plurality of gate lines and the eight data lines of each data line group of the plurality of data line groups.

The eight data lines include first-kind data lines and second-kind data lines. Each of the first-kind data lines is connected to one of two pixels that are arranged in a k-th (k is an odd or even number) pixel row and a (k+1)th pixel row. Each of the second-kind data lines is connected to two pixels that are arranged in different pixel columns in the k-th pixel row and the (k+1)th pixel row. At least two first-kind data lines are consecutively arranged.

The first-kind data lines include first, second, third, and fourth data lines, and the second-kind data lines include fifth, sixth, seventh, and eighth data lines. The two first-kind data lines that are consecutively arranged respectively correspond to the first and second data lines. The third data line is disposed to be spaced apart from the first and second data lines, and the fifth and sixth data lines are disposed between the third data line and the first and second data lines. The fourth data line is disposed consecutive to the third data line.

The fourth data line is disposed to be spaced apart from the first and second data lines, and the seventh and eighth data lines are disposed between the fourth data line and the first and second data lines.

The first data line is connected to one of the plurality of pixels arranged in the (k+1)th pixel row, and the second data line is connected to one of the plurality of pixels arranged in the k-th pixel row. The third data line is disposed more adjacent to the first data line than the second data line among the first and second data lines, the fourth data line is disposed more adjacent to the second data line than the first data line among the first and second data lines. The third data line is connected one of to the plurality of pixels arranged in the k-th pixel row, and the fourth data line is connected to one of the plurality of pixels arranged in the (k+1)th pixel row.

A first group of pixels of the plurality of pixels that is arranged in the k-th pixel row includes first to sixth pixels connected to the second, third, fifth, sixth, seventh, and eighth data lines. A second group of the plurality of pixels that is arranged in the (k+1)th pixel row includes seventh to twelfth pixels connected to the first, fourth, fifth, sixth, seventh, and eighth data lines. The first to twelfth pixels are arranged in a pixel matrix of two rows by six columns, and four pixels arranged in two consecutive pixel arranged in the pixel matrix respectively display red, green, blue, and white colors.

A first set of four pixels among a first set of six pixels arranged in a first pixel row of the pixel matrix respectively display the red, green, blue, and white colors, and a second set of four pixels among a second set of six pixels arranged in a second pixel row of the pixel matrix respectively display the blue, white, red, and green colors.

The first and second data lines receive data voltages having a same polarity. The first data line receives a first data voltage having a first polarity, the third data line receives a second data voltage having a second polarity opposite to the first polarity, and the fifth and sixth data lines respectively receive data voltages having opposite polarities to each other.

The fifth data line is disposed more adjacent to the third data line than the first data line among the first and third data lines, the sixth data line is disposed more adjacent to the first data line than the third data line among the first and third data lines, and the third and fifth data lines respectively receive data voltages having opposite polarities to each other.

The second data line receives a first data voltage having a first polarity, the fourth data line receives a second data voltage having a second polarity opposite to the first polarity, and the seventh and eighth data lines respectively receive data voltages having opposite polarities to each other.

The seventh data line is disposed more adjacent to the second data line than the fourth data line among the second and fourth data lines, the eighth data line is disposed more adjacent to the fourth data line than the second data line among the second and fourth data lines, and the second and seventh data lines respectively receive data voltages having opposite polarities to each other.

The first, second, third, fourth, fifth, sixth, seventh, and eighth data lines are arranged in an order of the third, fifth, sixth, first, second, seventh, eighth, and fourth data lines along the direction in which the plurality of gate lines extend. Among the third, fifth, sixth, and first data lines, adjacent data lines to each other receive data voltages having alternating polarities, and the second, seventh, eighth, and fourth data lines respectively receive the data voltages having polarities opposite to those of the data voltages applied to the third, fifth, sixth, and first data lines.

According to one embodiment, a method of driving a display apparatus includes providing pixels arranged in a pixel matrix of two rows by six columns, connecting the pixels to a plurality of gate lines comprising first and second gate lines, connecting the pixels to a plurality of data lines comprising first to eighth data lines. The plurality of data lines comprise a first set of four lines and a second set of four lines. The method further includes connecting each of the first set of four data lines among the first to eighth data lines to one of the pixels arranged in a first pixel row and a second pixel row and connecting each of the second set of four data lines among the first to eighth data lines to the pixels arranged both in the first pixel row and the second pixel row.

According to one embodiment, the method of driving a display apparatus further includes applying a gate signal to the first gate line during a horizontal period, applying data voltages to six data lines of the plurality of data lines that are connected to the pixels arranged in the first pixel row, and selectively applying data voltages to two data lines of the plurality of data lines that are not connected to the pixels arranged in the first pixel row when the data voltages are applied to the six data lines that are connected to the pixels arranged in the first pixel row.

According to the above, the pixels of the display apparatus are operated in a dot inversion method, and the moving line-stain phenomenon is reduced. In addition, the data voltages applied to the first-kind data lines are controlled, and thus the ripple phenomenon occurring in the common voltage is reduced.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
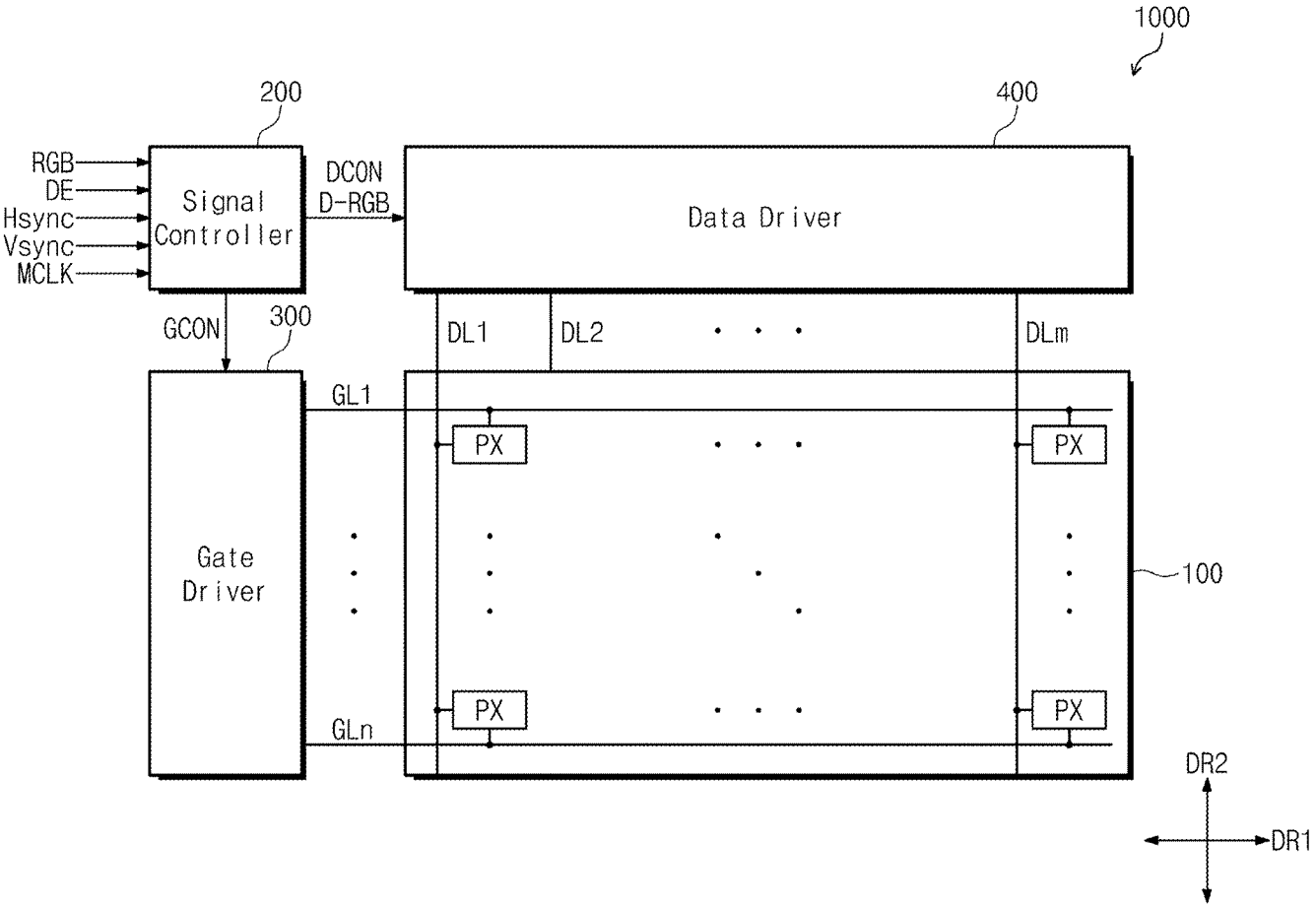
FIG. 1 is a block diagram showing a display apparatus according to an exemplary embodiment of the present disclosure.

It will be understood that when an element or layer is referred to as being "on," "connected to," or "coupled to" another element or layer, it may be directly on, connected, or coupled to the another element or layer, or one or more intervening elements or layers may be present therebetween. In contrast, when an element is referred to as being "directly on," "directly connected to," or "directly coupled to" another element or layer, there may be no intervening elements or layers therebetween. Like numbers refer to like elements throughout. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present disclosure.

Spatially relative terms, such as "beneath," "below," "lower," "above," "upper," and the like, may be used herein to describe one element or feature's relationship to another element(s) or feature(s). It will be understood that the spatially relative terms are intended to encompass different orientations of a device in use or operation in addition to the described and depicted orientation in the specification and figures. For example, if the device as illustrated in a figure is turned over, elements described as "below" or "beneath" other elements or features would then be oriented "above" the other elements or features. Thus, the term "below" can encompass both an orientation of above and below. The device may be otherwise oriented (rotated 90 degrees or at other orientations), and the spatially relative descriptors used herein are interpreted accordingly.

The terminology used herein is for the purpose of describing particular embodiments only and is not intended to be limiting of the present disclosure. As used herein, the singular forms, "a," "an," and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of a relevant art and will not be interpreted in an idealized or overly formal sense unless expressly so defined herein.

Hereinafter, the present disclosure will be explained in detail with reference to the accompanying drawings.

Figure 2:
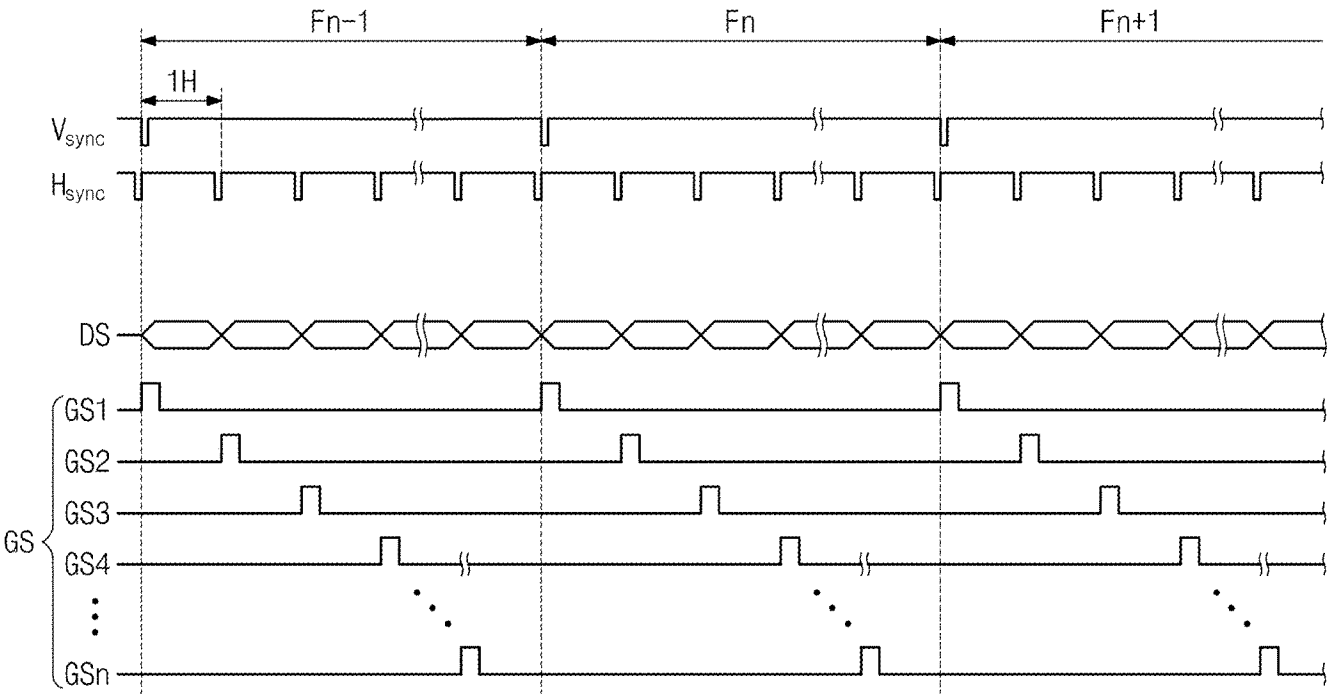
FIG. 2 is a timing diagram showing signals applied to a display apparatus according to an exemplary embodiment of the present disclosure.
Figure 3:
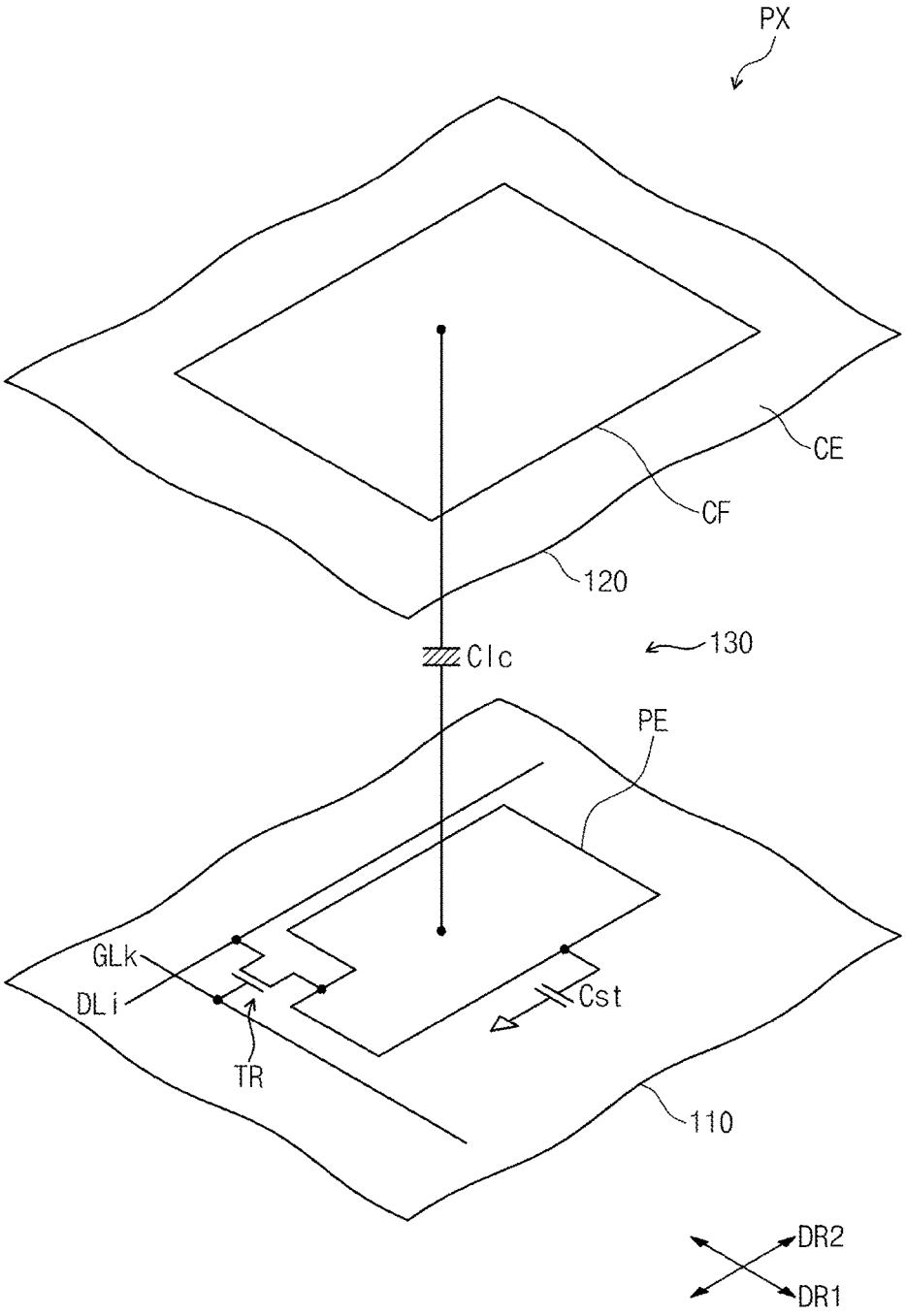
FIG. 3 is an equivalent circuit diagram of a pixel shown in FIG. 1.

FIG. 1 is a block diagram showing a display apparatus 1000 according to an exemplary embodiment of the present disclosure. FIG. 2 is a timing diagram showing signals applied to the display apparatus 1000 shown in FIG. 1. FIG. 3 is an equivalent circuit diagram of a pixel shown in FIG. 1.

Referring to FIGS. 1 and 2, the display apparatus 1000 includes a liquid crystal display panel 100, a signal controller 200, a gate driver 300, and a data driver 400. In the present exemplary embodiment, the liquid crystal display panel 100 is described as a representative example, but the liquid crystal display panel 100 may be replaced with other transmissive display panels, such as an electrophoretic display panel, an electrowetting display panel, etc.

The liquid crystal display panel 100 includes gate lines GL1 to GLn extending in a first direction DR1, data lines DL1 to DLm extending in a second direction DR2 crossing the first direction DR1, and pixels PX. The gate lines GL1 to GLn are arranged in the second direction DR2, and the data lines DL1 to DLm are arranged in the first direction DR1. Each of the pixels PX is activated (or turned on) in response to a corresponding gate signal of gate signals GS1 to GSn applied to the gate lines GL1 to GLn. Each of the pixels PX receives a corresponding data voltage of data voltages DS applied to the data lines DL1 to DLm.

The pixels PX are grouped into a plurality of groups according to colors displayed therein. Each pixel PX displays one of primary colors. For example, the primary colors include red, green, blue, and white colors, but they should not be limited thereto or thereby. The primary colors may include other colors, such as cyan, magenta, yellow.

The signal controller 200 receives image signals RGB and control signals from an external graphic controller (not shown). The control signals include a vertical synchronization signal Vsync to distinct frame periods Fn−1, Fn, and Fn+1, a horizontal synchronization signal Hsync as a row distinction signal to distinct horizontal periods 1H, a data enable signal DE maintained at a high level during a period, in which data are output, to indicate a data input period, and a main clock signal MCLK.

The signal controller 200 converts a data format of the image signals RGB to a data format appropriate to an interface between the signal controller 200 and the data driver 400. The signal controller 200 applies the converted image data D-RGB to the data driver 400. The signal controller 200 generates a gate control signal GCON and a data control signal DCON in response to the control signals. The signal controller 200 applies the gate control signal GCON to the gate driver 300 and applies the data control signal DCON to the data driver 400.

The gate control signal GCON includes a scan start signal indicating a start of scanning, at least one clock signal controlling an output period of a gate on voltage, and an output enable signal controlling the maintenance of the gate on voltage. The data control signal DCON includes a horizontal start signal indicating a start of transmitting the image data D-RGB to the data driver 400, a load signal indicating application of the data voltages to the data lines DL1 to DLm, and an inversion signal inverting a polarity of the data voltages with respect to a common voltage. The load signal has substantially the same period as that of the horizontal synchronization signal Hsync.

The gate driver 300 generates the gate signals GS1 to GSn in response to the gate control signal GCON during the frame periods Fn−1, Fn, and Fn+1 and applies the gate signals GS1 to GSn to the gate lines GL1 to GLn. The gate signals GS1 to GSn are sequentially output to correspond to the horizontal periods 1H.

The data driver 400 generates grayscale voltages corresponding to the image data D-RGB in response to the data control signal DCON and applies the grayscale voltages to the data lines DL1 to DLm as the data voltages DS. The data voltages DS include positive (+) data voltages having a positive value with respect to the common voltage and negative (−) data voltages having a negative value with respect to the common voltage. During each horizontal period 1H, a portion of the data voltages DS applied to the data lines DL1 to DLm has a positive polarity, and the other portion of the data voltages DS applied to the data lines DL1 to DLm has a negative polarity. The polarity of the data voltages DS is inverted in the frame periods Fn−1, Fn, and Fn+1 to prevent the liquid crystal molecules from burning or deteriorating. The data driver 400 generates the data voltages DS inverted in the unit of the frame period in response to the inversion signal.

Each of the signal controller 200, the gate driver 300, and the data driver 400 is directly mounted on the liquid crystal display panel 100 in one integrated circuit chip package or more, or attached to the liquid crystal display panel 100 in a tape carrier package form after being mounted on a flexible printed circuit board. At least one of the gate driver 300 and the data driver 400 may be integrated in the liquid crystal display panel 100 together with the gate lines GL1 to GLn, the data lines DL1 to DLm, and th pixels PX.

Referring to FIG. 3, the liquid crystal display panel 100 includes a lower substrate 110, an upper substrate 120 facing the lower substrate 110, and a liquid crystal layer 130 interposed between the lower substrate 110 and the upper substrate 120. FIG. 3 shows one gate line GLk among the gate lines GL1 to GLn (refer to FIG. 1) and one data line DLi among the data lines DL1 to DLm (refer to FIG. 1). The gate line GLk and the data line DLi are disposed on the lower substrate 110.

The pixel PX is defined between the lower substrate 110 and the upper substrate 120. The pixel PX includes a thin film transistor TR connected to the gate line GLk and the data line DLi, a liquid crystal capacitor Clc connected to the thin film transistor TR, and a storage capacitor Cst connected to the liquid crystal capacitor Clc in parallel. In some embodiments, the storage capacitor Cst may be omitted.

The thin film transistor TR includes a gate electrode connected to the gate line GLk, a drain electrode connected to the data line DLi, and a source electrode connected to the liquid crystal capacitor Clc and the storage capacitor Cst. The liquid crystal capacitor Clc includes a pixel electrode PE disposed on the lower substrate 110 and a common electrode CE disposed on the upper substrate 120 as its two electrodes and includes the liquid crystal layer 130 as a dielectric substance thereof. In one embodiment, the common electrode CE may be disposed on the lower substrate 110. In this case, at least one of the pixel electrode PE and the common electrode CE includes one or more slits.

The storage capacitor Cst includes the pixel electrode PE and a storage line (not shown) as its two electrodes and includes an insulating layer disposed between the pixel electrode PE and the storage line as a dielectric substance thereof. The storage line is applied with a constant voltage, e.g., a voltage having the same level as that of the common voltage.

A color filter CF is disposed on the upper substrate 120 to display a color of the pixel PX. In some embodiments, the color filter CF may be disposed on the lower substrate 110.

Figure 4A:
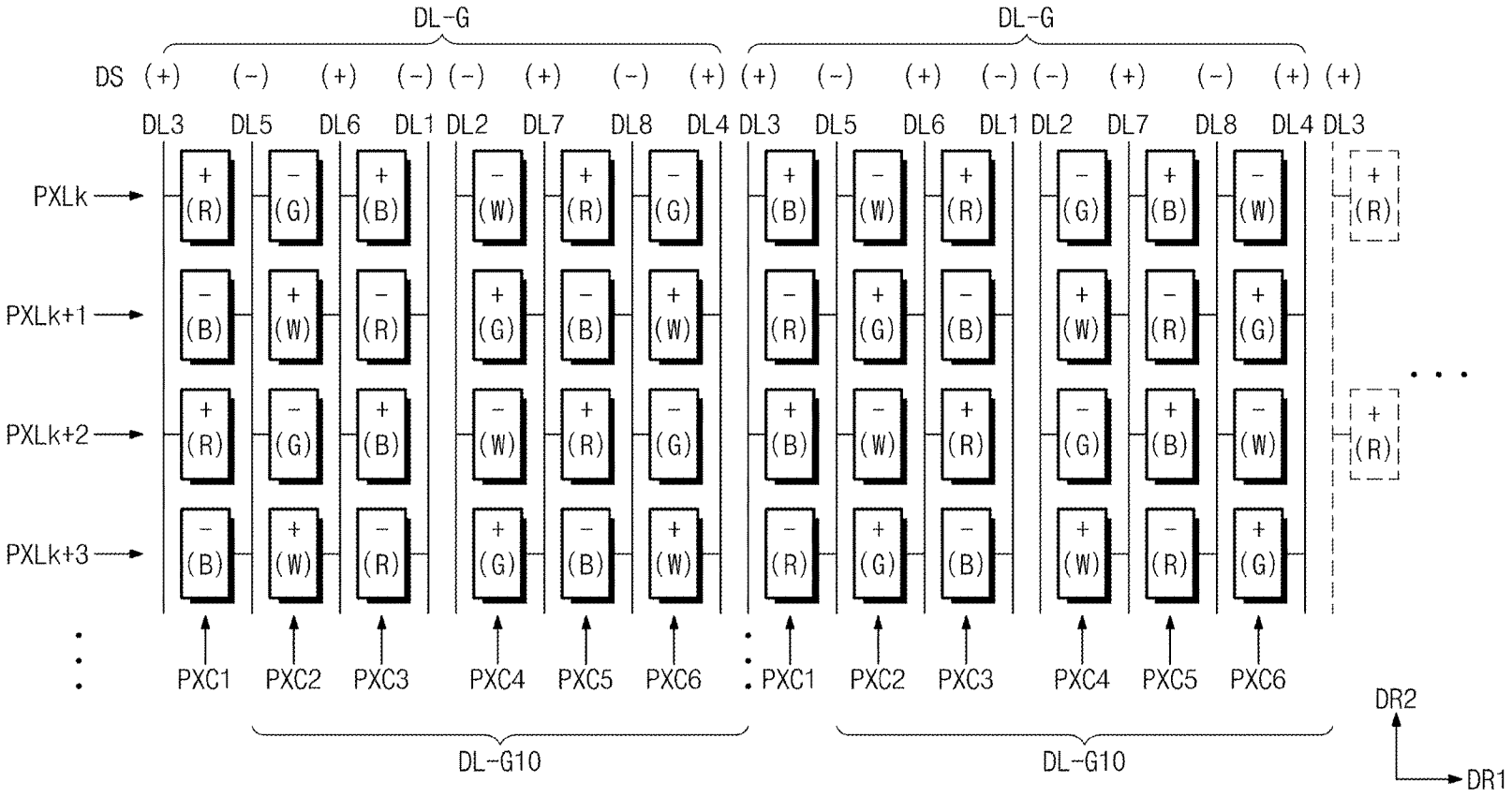
FIG. 4A is a plan view showing a display panel according to an exemplary embodiment of the present disclosure.
Figure 4B:
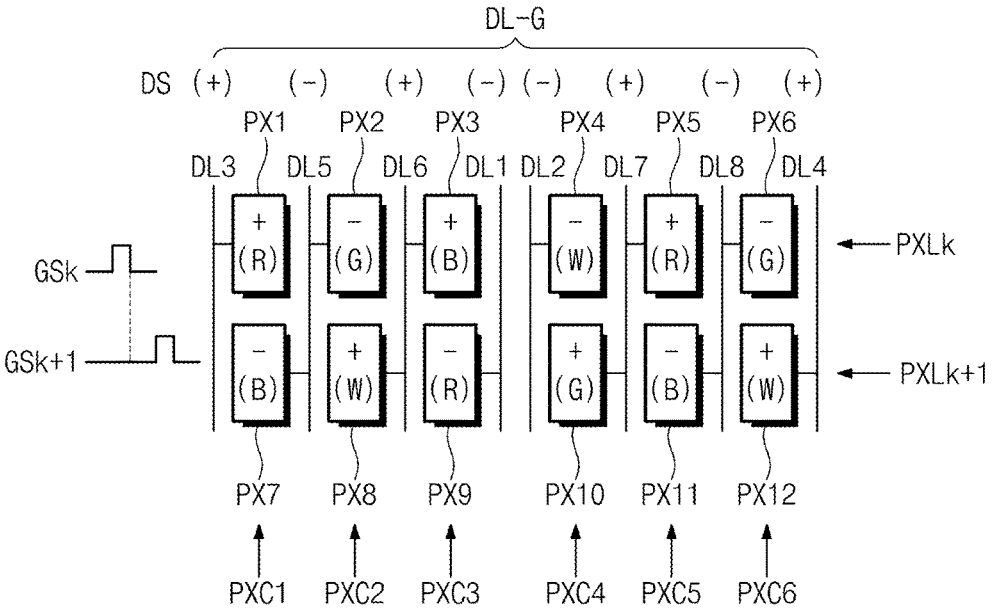
FIG. 4B is a plan view showing a portion of pixels shown in FIG. 4A.

FIG. 4A is a plan view showing a display panel according to an exemplary embodiment of the present disclosure. FIG. 4B is a plan view showing a portion of pixels shown in FIG. 4A. Hereinafter, the liquid crystal display panel will be described in detail with reference to FIGS. 4A and 4B.

FIG. 4A shows two data line groups DL-G each including eight data lines DL1 to DL8. Gate lines that are respectively connected to pixel rows PXLk to PXLk+3 are not shown in FIGS. 4A and 4B. The pixels PX shown in FIG. 4A are connected to the eight data lines DL1 to DL8 through the thin film transistors TR as described with reference to FIG. 3. Capitals of R, G, B, and W marked on the pixels PX indicate red, green, blue, and white colors displayed by the pixels PX, respectively. Signs of "+" and "−" marked on the pixels PX indicate the polarity of the data voltages applied to the pixels PX.

According to one embodiment, the eight data lines DL1 to DL8 included in each of the data line groups DL-G are classified into first-kind data lines and second-kind data lines. Each of the first-kind data lines is connected to one of the pixel of a k-th (k is an odd or even number) pixel row PXLk and the pixel of a (k+1)th pixel row PXLk+1, which are arranged in different pixel columns. The k-th pixel row PXLk is connected to a k-th gate line among the gate lines, and the (k+1)th pixel row PXLk+1 is connected to a (k+1)th gate line among the gate lines. Each of the second-kind data lines is connected to the pixel of the k-th pixel row PXLk and the pixel of the (k+1)th pixel row PXLk+1, which are arranged in different pixel columns. According to one embodiment, the first-kind data lines include first, second, third, and fourth data lines DL1, DL2, DL3, and DL4 and the second-kind data lines include fifth, sixth, seventh, and eighth data lines DL5, DL6, DL7, and DL8.

In the present exemplary embodiment, the data lines may be defined as different data line groups DL-G10 from the above-mentioned data line groups DL-G. The different line groups DL-G10 may include the data lines shifted to the right side than the data line groups DL-G.

In each of the data line groups DL-G and the different data line groups DL-G10, at least two first-kind data lines are consecutively arranged. In one embodiment, the first and second data lines DL1 and DL2 included in the data line groups DL-G are consecutively arranged. Here, the expression that the first and second data lines DL1 and DL2 are consecutively arranged means that a pixel PX is not disposed between the first data line DL1 and the second data line DL2 in the first direction DR1. Each of the data line groups DL-G10 defined as being different from the data line groups DL-G includes the first and second data lines DL1 and DL2 consecutively arranged, and the third and fourth data lines DL3 and DL4 consecutively arranged. Hereinafter, the data line groups DL-G will be mainly described.

The first data line DL1 is connected to the pixels arranged in the (k+1)th and (k+3)th pixel rows PXLk+1 and PXLk+3 among the pixels arranged in a third pixel column PXC3. The second data line DL2 is connected to the pixels arranged in the k-th and (k+2)th pixel rows PXLk and PXLk+2 among the pixels arranged in a fourth pixel column PXC4. The first and second data lines DL1 and DL2 are alternately connected to the pixel rows PXLk, PXLk+1, PXLk+2, and PXLk+3. For instance, the first data line DL1 is connected to the pixels arranged in even-numbered pixel rows, and the second data line DL2 is connected to the pixels arranged in odd-numbered pixel rows.

The third data line DL3 is disposed to be spaced apart from the first and second data lines DL1 and DL2 in the first direction DR1. Here, the expression that the third data line DL3 is disposed to be spaced apart from the consecutively arranged first and second data lines DL1 and DL2 in the first direction DR1 means that one or more pixels PX are disposed between the third data line DL3 and the consecutively arranged first and second data lines DL1 and DL2. The third data line DL3 is connected to the pixels arranged in the k-th pixel row PXLk and the (k+2)th pixel row PXLk+2 among the pixels arranged in a first pixel column PXC1.

The fifth and sixth data lines DL5 and DL6 are disposed between the third data line DL3 and the first and second data lines DL1 and DL2. The fifth data line DL5 is connected to the pixels arranged in the (k+1)th pixel row PXLk+1 and the (k+3)th pixel row PXLk+3 among the pixels arranged in the first pixel column PXC1 and the pixels arranged in the k-th pixel row PXLk and the (k+2)th pixel row PXLk+2 among the pixels arranged in a second pixel column PXC2. The sixth data line DL6 is connected to the pixels arranged in the (k+1)th pixel row PXLk+1 and the (k+3)th pixel row PXLk+3 among the pixels arranged in the second pixel column PXC2 and the pixels arranged in the k-th pixel row PXLk and the (k+2)th pixel row PXLk+2 among the pixels arranged in the third pixel column PXC3. Therefore, each of the fifth and sixth data lines DL5 and DL6 is alternately connected to the pixels arranged in different pixel rows among the pixels arranged two consecutive pixel columns.

The fourth data line DL4 is disposed to be spaced apart from the first data line DL1 and the second data line DL2 in the first direction DR1. The seventh and eighth data lines DL7 and DL8 are disposed between the fourth data line DL4 and the first and second data lines DL1 and DL2. Consequently, among the first, second, third, fourth, fifth, sixth, seventh, and eight data lines DL1, DL2, DL3, DL4, DL5, DL6, DL7, and DL8, the first and second data lines DL1 and DL2 are disposed at a center portion of the data line group DL-G, and the third and fourth data lines DL3 and DL4 are disposed at an outer portion of the data line group DL-G.

The first and second data lines DL1 and DL2, which are consecutively arranged, receive the data voltages DS having the same polarity during each of the frame periods Fn−1, Fn, and Fn+1. The polarity of the data voltages DS applied to the data lines may be inverted every one frame of the frame periods Fn−1, Fn, and Fn+1 by a frame inversion scheme. FIG. 4A shows the data voltages DS applied to the data lines during one frame period Fn (refer to FIG. 2) among the frame periods Fn−1, Fn, and Fn+1. The first and second data lines DL1 and DL2 receive the negative (−) data voltages DS.

When the first data line DL1 receives the negative (−) data voltage, the third data line DL3 receives the positive (+) data voltage opposite to the negative (−) data voltage. In this case, the fifth and sixth data lines DL5 and DL6 receive the data voltages DS having opposite polarities to each other, respectively.

Among the first and third data lines DL1 and DL3, the fifth data line DL5 that is disposed more adjacent to the third data line DL3 than the first data line DL1 receives the data voltage having the polarity opposite to that of the data voltage applied to the third data line DL3.

When the second data line DL2 receives the negative (−) data voltage, the fourth data line DL4 receives the positive (+) data voltage opposite to the negative (−) data voltage. In this case, the seventh and eighth data lines DL7 and DL8 receive the data voltages DS having opposite polarities to each other, respectively.

Among the second and fourth data lines DL2 and DL4, the seventh data line DL7 disposed more adjacent to the second data line DL2 than the fourth data line DL4 receives the data voltage having the polarity opposite to that of the data voltage applied to the second data line DL2.

Among the third, fifth, sixth, and first data lines DL3, DL5, DL6, and DL1, which are sequentially arranged in the first direction DR1, data lines adjacent to each other receive the data voltages having alternating polarities. The second, seventh, eighth, and fourth data lines DL2, DL7, DL8, and DL4 receive the data voltages having opposite polarities to those of the data voltages applied to the third, fifth, sixth, and first data lines DL3, DL5, DL6, and DL1, respectively. According to one embodiment, the pixels PX are operated in the dot inversion scheme based on the polarities of the data voltages DS applied to the first, second, third, fourth, fifth, sixth, seventh, and eighth data lines DL1, DL2, DL3, DL4, DL5, DL6, DL7, and DL8 and a connection structure between the first, second, third, fourth, fifth, sixth, seventh, and eighth data lines DL1, DL2, DL3, DL4, DL5, DL6, DL7, and DL8 and the pixels PX. When the pixels PX are operated in the dot inversion scheme, a moving line-stain phenomenon is reduced.

The pixels are described in detail with reference to FIG. 4B. FIG. 4B shows one data line group DL-G and the pixels connected to the data line group DL-G.

The pixels arranged in the k-th pixel row PXLk include first to sixth pixels PX1 to PX6 that are connected to the second, third, fifth, sixth, seventh, and eighth data lines DL2, DL3, DL5, DL6, DL7, and DL8. The pixels arranged in the (k+1)th pixel row PXLk+1 include seventh to twelfth pixels PX7 to PX12 connected to the first, fourth, fifth, sixth, seventh, and eighth data lines DL1, DL4, DL5, DL6, DL7, and DL8. The fifth, sixth, seventh, and eighth data lines DL5, DL6, DL7, and DL8 are connected to a corresponding pixel of the pixels arranged in the k-th pixel row PXLk and a corresponding pixel of the pixels arranged in the (k+1)th pixel row PXLk+1.

The first to twelfth pixels PX1 to PX12 are arranged in a pixel matrix of two rows by six columns. Four pixels arranged in two consecutive pixel columns among the pixels arranged in the pixel matrix of two rows by six columns display the red, green, blue, and white colors, respectively. The first and second pixel columns PXLk and PXLk+1 (refer to FIG. 4B) include the first pixel PX1 displaying the red (R), the second pixel PX2 displaying the green (G), the seventh pixel PX7 displaying the blue (B), and the eighth pixel PX8 displaying the white (W).

In the present exemplary embodiment, the arrangement of the pixels arranged in the above-mentioned two pixel columns may be repeated along the first direction DR1. However, among the pixels PX1 to PX12 arranged in the pixel matrix of two rows by six columns, four pixels among six pixels arranged in the first pixel row PXLk display the red (R), green (G), blue (B), and white (W) colors, and among the pixels PX1 to PX12 arranged in the pixel matrix of two rows by six columns, four pixels among six pixels arranged in the second pixel row PXLk+1 display the blue (B), white (W), red (R), green (G) colors.

The first to sixth pixels PX1 to PX6 arranged in the first pixel row PXLk are activated in response to a k-th gate signal GSk applied to the k-th gate line. The first to sixth pixels PX1 to PX6 receive the data voltages DS applied to corresponding data lines DL3, DL5, DL6, DL2, DL7, and DL8 among the first to eighth data lines DL1 to DL8. In this case, the data voltages DS may be selectively applied to the data lines DL1 and DL4, which are not connected to the first to sixth pixels PX1 to PX6 arranged in the first pixel row PXLk. To reduce ripples that may occur in the common voltage, the data voltages that are not applied to the pixels may be applied to the first and fourth data lines DL1 and DL4. This will be described in detail with reference to FIGS. 5A to 7B.

After the k-th gate signal GSk is applied to the k-th gate line, the (k+1)th gate signal GSk+1 is applied to the (k+1)th gate line. The seventh to twelfth pixels PX7 to PX12 arranged in the second pixel row PXLk+1 are activated in response to the (k+1)th gate signal GSk+1. The seventh to twelfth pixels PX7 to PX12 receive the data voltages DS applied to corresponding data lines DL5, DL6, DL1, DL7, DL8, and DL4 among the first to eighth data lines DL1 to DL8. In this case, the data voltages may be selectively applied to the data lines DL3 and DL2 that are not connected to the seventh to twelfth pixels PX7 to PX12 arranged in the second pixel row PXLk+1.

Figure 5A:
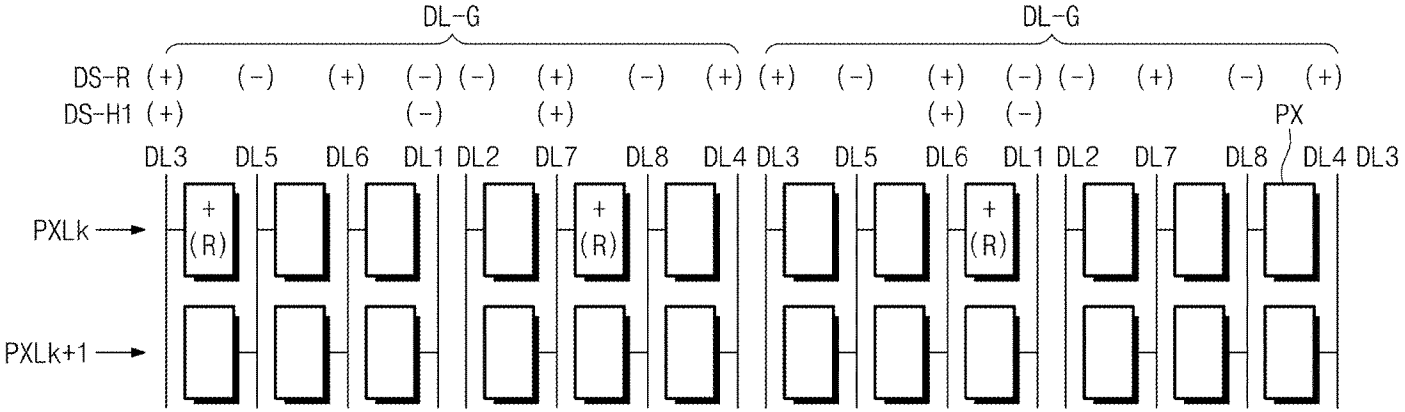
FIG. 5A is a plan view showing a display panel operated during a first horizontal period.
Figure 5B:
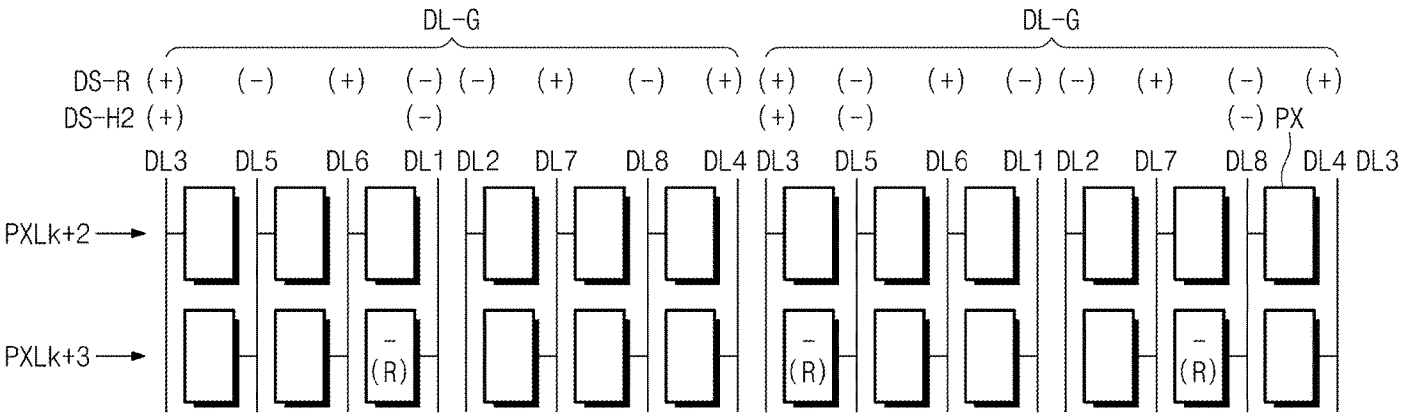
FIG. 5B is a plan view showing a display panel operated during a second horizontal period.

FIG. 5A is a plan view showing a display panel operated during a first horizontal period. FIG. 5B is a plan view showing a display panel operated during a second horizontal period.

FIG. 5A separately shows data voltages DS-H1 applied to a portion of the pixels during the first horizontal period compared to data voltages DS-R applied to all the pixels PX arranged in the k-th pixel row PXLk. The data voltages may be applied to only the portion of the pixels among the pixels in accordance with the image to be displayed. For instance, among the pixels PX arranged in the k-th pixel row PXLk, only the red (R) pixels PX may be activated as shown in FIG. 5A. The red (R) pixels PX are applied with the positive (+) data voltage DS-H1. Ripples having a positive (+) voltage may be occurred in the common voltage.

According to the present exemplary embodiment, when the data voltage is applied to the data lines DL1 that are not connected to the pixels PX arranged in the k-th pixel row PXLk, ripples may be prevented or reduced in the common voltage. When ripples having the positive (+) voltage are occurred in the common voltage, the negative (−) data voltage may be applied to the first data line DL1. The negative (−) data voltage reduces the ripples in the common voltage. It is preferred that the data voltage is not applied to the fourth data line DL4, which is set to receive the positive (+) data voltage DS-R during the first horizontal period.

FIG. 5B separately shows data voltages DS-H2 applied to a portion of the pixels during the second horizontal period compared to the data voltages DS-R applied to all the pixels PX arranged in the (k+1)th pixel row PXLk+1. For instance, among the pixels PX arranged in the (k+3)th pixel row PXLk+3, only the red (R) pixels PX may be activated as shown in FIG. 5B. The red (R) pixels PX are applied with the negative (−) data voltage DS-H2. Ripples having a negative (−) voltage may be occurred in the common voltage.

According to the present exemplary embodiment, when the data voltage is applied to the data lines DL3 that are not connected to the pixels PX arranged in the (k+3)th pixel row PXLk+3, ripples may be prevented or reduced in the common voltage. When ripples having negative (−) voltage are occurred in the common voltage, the positive (+) data voltage may be applied to the third data line DL3. The positive (+) data voltage reduces the ripples in the common voltage. It is preferred that the data voltage is not applied to the second data line DL2, which is set to receive the negative (−) data voltage DS-R during the second horizontal period.

Figure 6A:
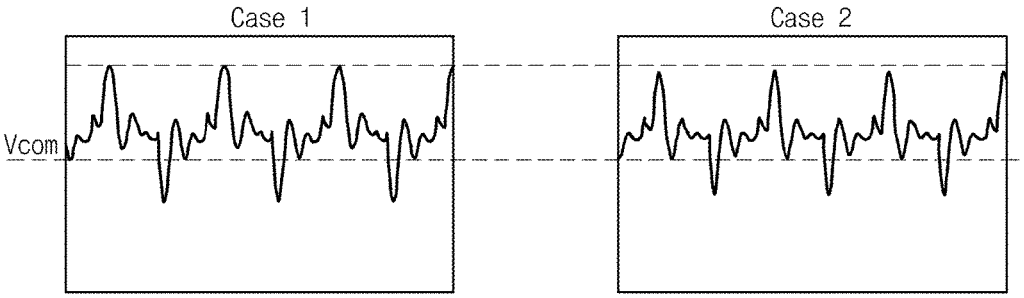
FIG. 6A is a graph showing ripples in a common voltage of a comparison example and an embodiment example.
Figure 6B:
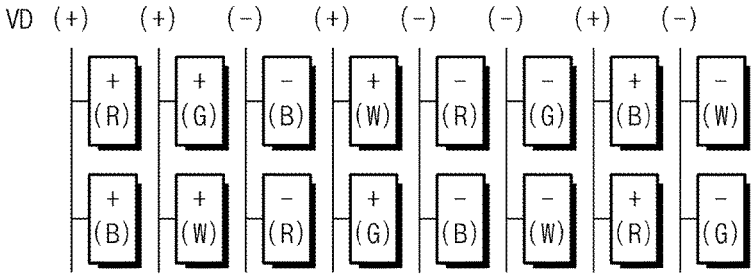
FIG. 6B is a plan view showing a display panel of a display apparatus according to a comparison example.

FIG. 6A is a graph showing ripples in a common voltage of a comparison example and an embodiment example. FIG. 6B is a plan view showing a display panel of a display apparatus according to a comparison example.

A first case1 represents the ripples in the common voltage of the display panel shown in FIG. 6B whereas a second case2 represents the ripples in the common voltage according to the present disclosure, for example FIGS. 5A and 5B. As represented by the second case2, a peak of the ripples in the common voltage is reduced compared to that of the ripples in the common voltage represented by the first case1. This is because the data voltage is applied to the data line not connected to pixels arranged in an arbitrary pixel row as a ripple prevention voltage when the arbitrary pixel row is activated, as described with reference to FIGS. 5A and 5B. However, according to the display panel shown in FIG. 6B, pixels that are arranged in each pixel row are connected to the data lines in a one-to-one correspondence, and the ripple prevention voltage may cause a malfunction in the pixels, therefore the ripple prevention voltage may not be applied to the data line.

Although the exemplary embodiments of the present disclosure have been described, it is understood that the present disclosure should not be limited to these exemplary embodiments but various changes and modifications can be made by one ordinary skilled in the art within the spirit and scope of the present disclosure as hereinafter claimed.

What is claimed is:

1. A display apparatus comprising:

a plurality of gate lines;

a plurality of data line groups, each data line group of the plurality of data line groups comprising eight data lines sequentially arranged and repeating in a first direction in which the plurality of gate lines extend; and a plurality of pixels connected to the plurality of gate lines and the eight data lines of each data line group of the plurality of the data line groups, wherein the eight data lines comprise first-kind data lines and second-kind data lines, wherein each of the first-kind data lines is connected to one of two pixels that are arranged in a k-th pixel row and a (k+1)th pixel row, wherein each of the second-kind data lines is connected to two pixels that are arranged in different pixel columns in the k-th pixel row and the (k+1)th pixel row, wherein the first-kind data lines comprise first, second, third, and fourth data lines, and the second-kind data lines comprise fifth, sixth, seventh, and eighth data lines, wherein the first, second, third, fourth, fifth, sixth, seventh, and eighth data lines are arranged in an order of the third, fifth, sixth, first, second, seventh, eighth, and fourth data lines along the first direction, and wherein each of the first, second, fifth and eighth data lines respectively receives a first data voltage having a first polarity, and each of the third, fourth, sixth and seventh data lines respectively receives a second data voltage having a second polarity opposite to the first polarity.

2. The display apparatus of claim 1, wherein the at least two first-kind data lines that are consecutively arranged respectively correspond to the first and second data lines, wherein the third data line is disposed to be spaced apart from the first and second data lines, and wherein the fifth and sixth data lines are disposed between the third data line and the first and second data lines.

3. The display apparatus of claim 1, wherein the first data line is connected to one of the plurality of pixels arranged in the (k+1)th pixel row, and wherein the second data line is connected to one of the plurality of pixels arranged in the k-th pixel row.

4. The display apparatus of claim 3, wherein a first group of pixels of the plurality of pixels that is arranged in the k-th pixel row comprises first to sixth pixels connected to the second, third, fifth, sixth, seventh, and eighth data lines, wherein the a second group of the plurality of pixels that is arranged in the (k+1)th pixel row comprises seventh to twelfth pixels connected to the first, fourth, fifth, sixth, seventh, and eighth data lines, wherein the first to twelfth pixels are arranged in a pixel matrix of two rows by six columns, and wherein four pixels arranged in two consecutive pixel columns arranged in the pixel matrix respectively display red, green, blue, and white colors.

5. The display apparatus of claim 4, wherein a first set of four pixels among a first set of six pixels arranged in a first pixel row of the pixel matrix display the red, green, blue, and white colors, and wherein a second set of four pixels among a second set of six pixels arranged in a second pixel row of the pixel matrix display the red, green, blue, and white colors.

6. A method of driving a display apparatus comprising:

providing pixels arranged in a pixel matrix of two rows by six columns;

connecting the pixels to a plurality of gate lines comprising first and second gate lines;

connecting the pixels to a plurality of data lines comprising first to eighth data lines, wherein the plurality of data lines comprise a first set of four lines and a second set of four lines;

connecting each of the first set of four data lines among the first to eighth data lines to one of the pixels arranged in a first pixel row and a second pixel row;

connecting each of the second set of four data lines among the first to eighth data lines to the pixels arranged both in the first pixel row and the second pixel row;

applying a gate signal to the first gate line during a horizontal period;

applying data voltages to six data lines of the plurality of data lines that are connected to the pixels arranged in the first pixel row; and selectively applying data voltages to two data lines of the plurality of data lines that are not connected to the pixels arranged in the first pixel row when the data voltages are applied to the six data lines that are connected to the pixels arranged in the first pixel row.

* * * * *